US010115364B2

(12) United States Patent
Wang

(10) Patent No.: US 10,115,364 B2
(45) Date of Patent: Oct. 30, 2018

(54) SCANNING DEVICE CIRCUITS AND FLAT DISPLAY DEVICES HAVING THE SAME

(71) Applicant: Wuhan China Star Optoelectronics Technology Co., Ltd., Wuhan, Hubei (CN)

(72) Inventor: Cong Wang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 174 days.

(21) Appl. No.: 15/316,560

(22) PCT Filed: Nov. 16, 2016

(86) PCT No.: PCT/CN2016/106045
§ 371 (c)(1),
(2) Date: Dec. 6, 2016

(87) PCT Pub. No.: WO2018/035996
PCT Pub. Date: Mar. 1, 2018

(65) Prior Publication Data

US 2018/0190230 A1 Jul. 5, 2018

(30) Foreign Application Priority Data

Aug. 22, 2016 (CN) ..... 2016 1 0703365

(51) Int. Cl.
*G09G 3/36* (2006.01)
*G09G 3/20* (2006.01)
*G09G 3/3266* (2016.01)

(52) U.S. Cl.
CPC ..... *G09G 3/3677* (2013.01); *G09G 3/20* (2013.01); *G09G 3/3266* (2013.01);
(Continued)

(58) Field of Classification Search
CPC ..... G09G 3/3677; G09G 3/20; G09G 3/3266; G09G 2300/0823; G09G 2310/0283; G09G 2310/062; G09G 2310/08
See application file for complete search history.

(56) References Cited

U.S. PATENT DOCUMENTS

2011/0228893 A1* 9/2011 Tobita ..... G11C 19/184 377/77
2016/0351151 A1 12/2016 Cao

FOREIGN PATENT DOCUMENTS

CN 103871342 A 6/2014
CN 105702189 A 6/2016
(Continued)

*Primary Examiner* — Sejoon Ahn
(74) *Attorney, Agent, or Firm* — Andrew C. Cheng

(57) ABSTRACT

The present disclosure relates to a scanning driving circuit and a flat display device. The scanning driving circuit includes a plurality of cascaded-connected scanning driving units respectively arranged at two lateral sides of a flat display device. With respect to the same level, the scanning driving unit at both sides connect to two the same scanning lines. Each of the scanning driving units includes: an input circuit configured to charge a pull-up and a pull-down control signal points; a latch circuit configured to latch signals received from the input circuit; a reset circuit configured to reset a level of the pull-up control signal point; an output circuit configured to generate scanning driving signals; and a clock control circuit configured to selectively output the scanning driving signals to the first scanning line or the second scanning line via third clock signals or fourth clock signals.

7 Claims, 6 Drawing Sheets

(52) U.S. Cl.
CPC ..... *G09G 2300/0823* (2013.01); *G09G 2310/0283* (2013.01); *G09G 2310/062* (2013.01); *G09G 2310/08* (2013.01)

(56) References Cited

FOREIGN PATENT DOCUMENTS

| | | | |
|---|---|---|---|
| CN | 105810165 | A | 7/2016 |
| KR | 1020080069441 | A | 7/2008 |

* cited by examiner

SCANNING DEVICE CIRCUITS AND FLAT DISPLAY DEVICES HAVING THE SAME

BACKGROUND OF THE INVENTION

1. Field of the Invention

The present disclosure relates to display technology, and more particularly to a scanning driving circuit and the flat display device having the same.

2. Discussion of the Related Art

Currently, scanning driving circuits are adopted in flat displays, that is, the manufacturing process of thin film transistors (TFT) flat displays is adopted to configure the scanning driving circuit on an array substrate to realize the driving method conducted row by row. In order to reduce the manufacturing cost, conventional scanning driving circuits adopt the left-right dual-driving mode. That is, the scanning driving unit in the left side controls the scanning lines in the odd rows, and the scanning driving unit in the right side controls the scanning lines in the even rows, and such control is conducted in accordance with the scanning signals in an interleaved manner. As such, one scanning line is driven by the scanning driving unit in a single side, which results in a greater loading. In addition, the signals delay of the output ends of the scanning driving signals may be greater with respect to the farther output ends. The voltages at two lateral sides of the panel may be difference, which affects the display performance of the panel.

Generally, a dual-direction driving method is adopted, that is, the scanning driving units at the left and right sides transmit the scanning driving signals to one scanning line at the same. However, two scanning driving units have to be configured for one scanning line. Under the circumstance, not only a plurality of scanning lines, but also a plurality of scanning driving units have to be configured. This attributes to complicated circuit design and more occupied space, which may affect the narrow border design more difficult.

SUMMARY

The present disclosure relates to a scanning driving circuit and a flat display having the same to simplify the circuit of the flat display device and to save the cost. Not only the narrow border design may be realized, the display performance of the flat display panel may remain the same.

In one aspect, a scanning driving circuit includes: a plurality of cascaded-connected scanning driving units respectively arranged at two lateral sides of a flat display device, with respect to the same level, the scanning driving unit at a right side and the scanning driving unit at a left side connect to two the same scanning lines, each of the scanning driving units includes: an input circuit is configured to receive input signals and first clock signals to charge a pull-up control signal point and a pull-down control signal point; a latch circuit connected to the input circuit, and the latch circuit is configured to latch signals received from the input circuit; a reset circuit connected to the input circuit and the latch circuit, and the reset circuit is configured to reset a level of the pull-up control signal point; an output circuit connected to the latch circuit, and the output circuit is configured to process second clock signals and data receives from the latch circuit to generate scanning driving signals; and a clock control circuit connected to the output circuit, and the clock control circuit selectively outputs the scanning driving signals outputted from the output circuit to the first scanning line or the second scanning line via third clock signals or fourth clock signals to drive a corresponding pixel cell; the output circuit includes a first inverter and a first clock control inverter, an input end of the first inverter connects to a second end of the first clock control inverter and the latch circuit to receive the first clock signals, an output end of the first inverter connects to a first end of the first clock control inverter and the latch circuit, an input end of the first clock control inverter receives input signals, and an output end of the first clock control inverter connects to the reset circuit and the latch circuit; the latch circuit includes a second inverter and a second clock control inverter, an input end of the second inverter connects to the output end of the first clock control inverter, an output end of the second clock control inverter, and the reset circuit, an output end of the second inverter connects to the input end of the second clock control inverter and the output circuit to receive low-level transmission signals, a first end of the second clock control inverter connects to the second end of the first clock control inverter and receives the first clock signals, and a second end of the second clock control inverter connects to the first end of the first clock control inverter and the output end of the first inverter; the reset circuit includes a first controllable transistor, a control end of the first controllable transistor receives the reset signals, a first end of the first controllable transistor connects to the output end of the first clock control inverter, the output end of the second clock control inverter, and the input end of the second inverter, and a second end of the first controllable transistor receives turn-on voltage end signals; the first controllable transistor is a P-type thin film transistor (TFT), the control end, the first end, and the second end of the first controllable transistor respectively correspond to a gate, a drain, and a source of the P-type TFT; the output circuit includes an NAND gate and third to fifth inverters, a first input end of the NAND gate receives the second clock signals, a second input end of the NAND gate connects to the input end of the second clock control inverter and the output end of the second inverter, an output end of the NAND gate connects to an input end of the third inverter, an output end of the third inverter connects to an input end of the fourth inverter, an output end of the fourth inverter connects to an input end of the fifth inverter, and an output end of the fifth inverter connects to the clock control circuit.

In another aspect, a scanning driving circuit includes: a plurality of cascaded-connected scanning driving units respectively arranged at two lateral sides of a flat display device, with respect to the same level, the scanning driving unit at a right side and the scanning driving unit at a left side connect to two the same scanning lines, each of the scanning driving units includes: an input circuit is configured to receive input signals and first clock signals to charge a pull-up control signal point and a pull-down control signal point; a latch circuit connected to the input circuit, and the latch circuit is configured to latch signals received from the input circuit; a reset circuit connected to the input circuit and the latch circuit, and the reset circuit is configured to reset a level of the pull-up control signal point; an output circuit connected to the latch circuit, and the output circuit is configured to process second clock signals and data receives from the latch circuit to generate scanning driving signals; and a clock control circuit connected to the output circuit, and the clock control circuit selectively outputs the scanning driving signals outputted from the output circuit to the first scanning line or the second scanning line via third clock signals or fourth clock signals to drive a corresponding pixel cell.

Wherein the output circuit includes a first inverter and a first clock control inverter, an input end of the first inverter connects to a second end of the first clock control inverter and the latch circuit to receive the first clock signals, an output end of the first inverter connects to a first end of the first clock control inverter and the latch circuit, an input end of the first clock control inverter receives input signals, and an output end of the first clock control inverter connects to the reset circuit and the latch circuit.

Wherein the latch circuit includes a second inverter and a second clock control inverter, an input end of the second inverter connects to the output end of the first clock control inverter, an output end of the second clock control inverter, and the reset circuit, an output end of the second inverter connects to the input end of the second clock control inverter and the output circuit to receive low-level transmission signals, a first end of the second clock control inverter connects to the second end of the first clock control inverter and receives the first clock signals, and a second end of the second clock control inverter connects to the first end of the first clock control inverter and the output end of the first inverter.

Wherein the reset circuit includes a first controllable transistor, a control end of the first controllable transistor receives the reset signals, a first end of the first controllable transistor connects to the output end of the first clock control inverter, the output end of the second clock control inverter, and the input end of the second inverter, and a second end of the first controllable transistor receives turn-on voltage end signals.

Wherein the first controllable transistor is a P-type thin film transistor (TFT), the control end, the first end, and the second end of the first controllable transistor respectively correspond to a gate, a drain, and a source of the P-type TFT.

Wherein the output circuit includes an NAND gate and third to fifth inverters, a first input end of the NAND gate receives the second clock signals, a second input end of the NAND gate connects to the input end of the second clock control inverter and the output end of the second inverter, an output end of the NAND gate connects to an input end of the third inverter, an output end of the third inverter connects to an input end of the fourth inverter, an output end of the fourth inverter connects to an input end of the fifth inverter, and an output end of the fifth inverter connects to the clock control circuit.

Wherein the clock control circuit includes second to fifth controllable transistors, a control end of the second controllable transistor connects to a control end of the third controllable transistor to receive third clock signals, a first end of the second controllable transistor receives the turn-off voltage end signals, a second end of the second controllable transistor, a second end of the second controllable transistor connects to a first end of the third controllable transistor and the first scanning line, a second end of the third controllable transistor connects to a first end of the fourth controllable transistor and an output end of the fifth inverter, a control end of the fourth controllable transistor connects to the control end of the fifth controllable transistor to receive fourth clock signals, a second end of the fourth controllable transistor connects to a first end of the fifth controllable transistor and the second scanning line, and a second end of the fifth controllable transistor receives the turn-off voltage end signals.

Wherein the second to the fifth controllable transistors are P-type TFTs, the control ends, the first ends, the second ends of the second to the fifth controllable transistors respectively correspond to the gate, drain, and the source of the P-type TFTs, the third to the fourth controllable transistors are N-type TFTs, and the control ends, the first ends, and the second ends of the third controllable transistor and the fourth controllable transistor respectively correspond to the gate, the drain, and the source of the N-type TFTs.

In another aspect, a flat display device includes: a plurality of cascaded-connected scanning driving units respectively arranged at two lateral sides of a flat display device, with respect to the same level, the scanning driving unit at a right side and the scanning driving unit at a left side connect to two the same scanning lines, each of the scanning driving units includes: an input circuit is configured to receive input signals and first clock signals to charge a pull-up control signal point and a pull-down control signal point; a latch circuit connected to the input circuit, and the latch circuit is configured to latch signals received from the input circuit; a reset circuit connected to the input circuit and the latch circuit, and the reset circuit is configured to reset a level of the pull-up control signal point; an output circuit connected to the latch circuit, and the output circuit is configured to process second clock signals and data receives from the latch circuit to generate scanning driving signals; and a clock control circuit connected to the output circuit, and the clock control circuit selectively outputs the scanning driving signals outputted from the output circuit to the first scanning line or the second scanning line via third clock signals or fourth clock signals to drive a corresponding pixel cell.

Wherein the output circuit includes a first inverter and a first clock control inverter, an input end of the first inverter connects to a second end of the first clock control inverter and the latch circuit to receive the first clock signals, an output end of the first inverter connects to a first end of the first clock control inverter and the latch circuit, an input end of the first clock control inverter receives input signals, and an output end of the first clock control inverter connects to the reset circuit and the latch circuit.

Wherein the latch circuit includes a second inverter and a second clock control inverter, an input end of the second inverter connects to the output end of the first clock control inverter, an output end of the second clock control inverter, and the reset circuit, an output end of the second inverter connects to the input end of the second clock control inverter and the output circuit to receive low-level transmission signals, a first end of the second clock control inverter connects to the second end of the first clock control inverter and receives the first clock signals, and a second end of the second clock control inverter connects to the first end of the first clock control inverter and the output end of the first inverter.

Wherein the reset circuit includes a first controllable transistor, a control end of the first controllable transistor receives the reset signals, a first end of the first controllable transistor connects to the output end of the first clock control inverter, the output end of the second clock control inverter, and the input end of the second inverter, and a second end of the first controllable transistor receives turn-on voltage end signals.

Wherein the first controllable transistor is a P-type thin film transistor (TFT), the control end, the first end, and the second end of the first controllable transistor respectively correspond to a gate, a drain, and a source of the P-type TFT.

Wherein the output circuit includes an NAND gate and third to fifth inverters, a first input end of the NAND gate receives the second clock signals, a second input end of the NAND gate connects to the input end of the second clock control inverter and the output end of the second inverter, an output end of the NAND gate connects to an input end of the third inverter, an output end of the third inverter connects to an input end of the fourth inverter, an output end of the fourth inverter connects to an input end of the fifth inverter, and an output end of the fifth inverter connects to the clock control circuit.

Wherein the clock control circuit includes second to fifth controllable transistors, a control end of the second controllable transistor connects to a control end of the third controllable transistor to receive third clock signals, a first end of the second controllable transistor receives the turn-off voltage end signals, a second end of the second controllable transistor, a second end of the second controllable transistor connects to a first end of the third controllable transistor and the first scanning line, a second end of the third controllable transistor connects to a first end of the fourth controllable transistor and an output end of the fifth inverter, a control end of the fourth controllable transistor connects to the control end of the fifth controllable transistor to receive fourth clock signals, a second end of the fourth controllable transistor connects to a first end of the fifth controllable transistor and the second scanning line, and a second end of the fifth controllable transistor receives the turn-off voltage end signals.

Wherein the second to the fifth controllable transistors are P-type TFTs, the control ends, the first ends, the second ends of the second to the fifth controllable transistors respectively correspond to the gate, drain, and the source of the P-type TFTs, the third to the fourth controllable transistors are N-type TFTs, and the control ends, the first ends, and the second ends of the third controllable transistor and the fourth controllable transistor respectively correspond to the gate, the drain, and the source of the N-type TFTs.

Wherein the flat display device is a liquid crystal device (LCD) or an organic light-emitting diode (OLED).

In view of the above, the left and the right side of the flat display device are respectively configured with cascaded-connected scanning driving units, wherein the levels of the scanning driving units for the left side and the right side are the same. The scanning driving units at the right side and the left side of the same level connect to the two same scanning line such that the scanning driving signals are selectively outputted to two scanning lines to drive the corresponding pixel cell via the clock control circuit. The input circuit charges the pull-up control signal point and the pull-down control signal point, and the signals are latched by the latch circuit. The output circuit generates the scanning driving signals and the scanning driving signals are selectively outputted to the first or second scanning lines to drive the corresponding pixel cell by the clock control circuit. With such configuration, the voltages at two sides of the flat display device may be the same. Not only the circuit design may be simplified, but also the space occupied by the circuit is reduced. Thus, the narrow border design of the flat may be realized.

DETAILED DESCRIPTION OF THE EMBODIMENTS

Embodiments of the invention will now be described more fully hereinafter with reference to the accompanying drawings, in which embodiments of the invention are shown.

Figure 1:
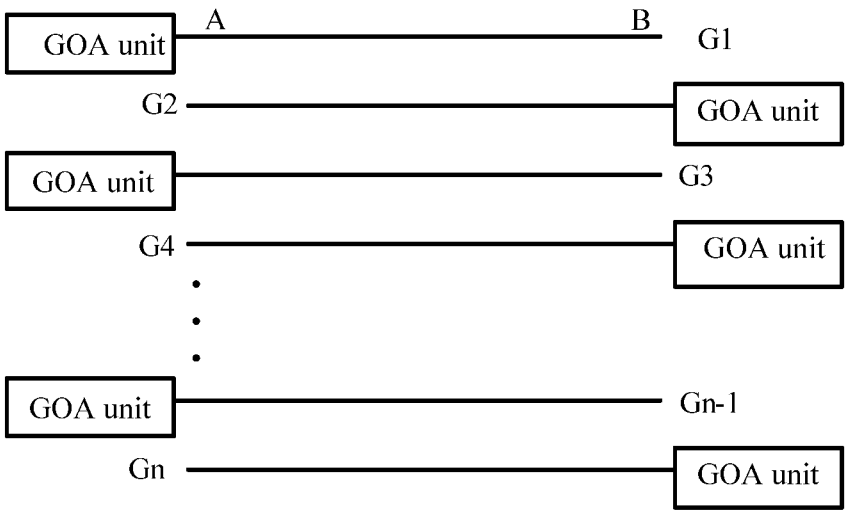
FIG 1(Prior Art)
FIGS. 1 and 2 are schematic views of the driving method of one conventional scanning driving circuit.
Figure 2:
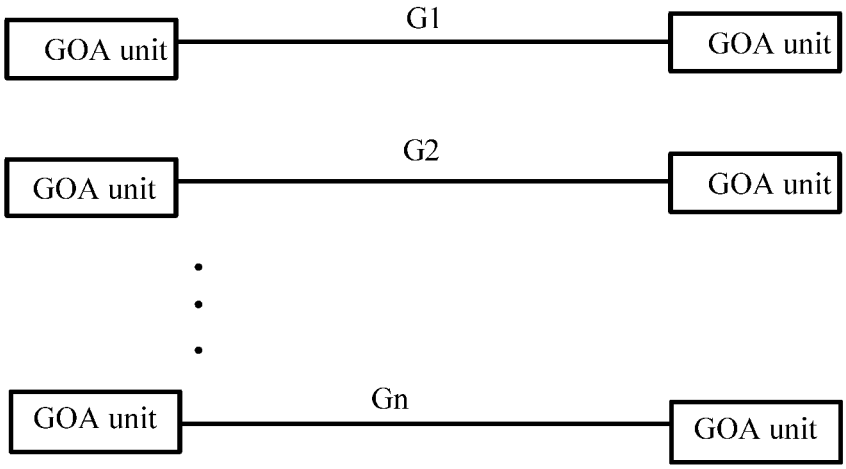
FIG 2(Prior Art)

FIG. 1 is a schematic view of the driving method of one conventional scanning driving circuit. The scanning driving unit in the left side controls the scanning lines in the odd rows, and the scanning driving unit in the right side controls the scanning lines in the even rows, and such control is conducted in accordance with the scanning signals in an interleaved manner. That is, on scanning line is turned on by the scanning driving signals transmitted from the scanning driving unit at one lateral side. With respect to the panel having the resolution rate of m×n, the panel includes m number of scanning lines, that is, there are m/2 levels for the scanning driving units at the left side, and there are m/2 levels for the scanning driving units at the right side, wherein each of the scanning driving units at the left side are controlled by the clock signals (CK1, CK2). Each of the scanning driving units at the right side are controlled by the clock signals (CK3, CK4), and the scanning driving units at the left and the right side are turned on by the scanning signals in an interleaved manner. As such, one scanning line is driven by the scanning driving unit in a single side, which results in a greater loading. In addition, the signals delay of the output ends of the scanning driving signals may be greater with respect to the farther output ends. The voltages at two lateral sides of the panel may be different, which affects the display performance of the panel. FIG. 2 is a schematic view of one conventional scanning driving circuit adopting the dual-direction driving method. That is, the scanning driving units at the left and right sides transmit the scanning driving signals to one scanning line at the same. However, two scanning driving units have to be configured for one scanning line. Under the circumstance, not only a plurality of scanning lines, but also a plurality of scanning driving units have to be configured (see FIG. 3). Each of the scanning driving units includes an input circuit 10, a latch circuit 20, a reset circuit 30, and an output circuit 40. This attributes to complicated circuit design and more occupied space, which may affect the narrow border design more difficult.

Figure 3:
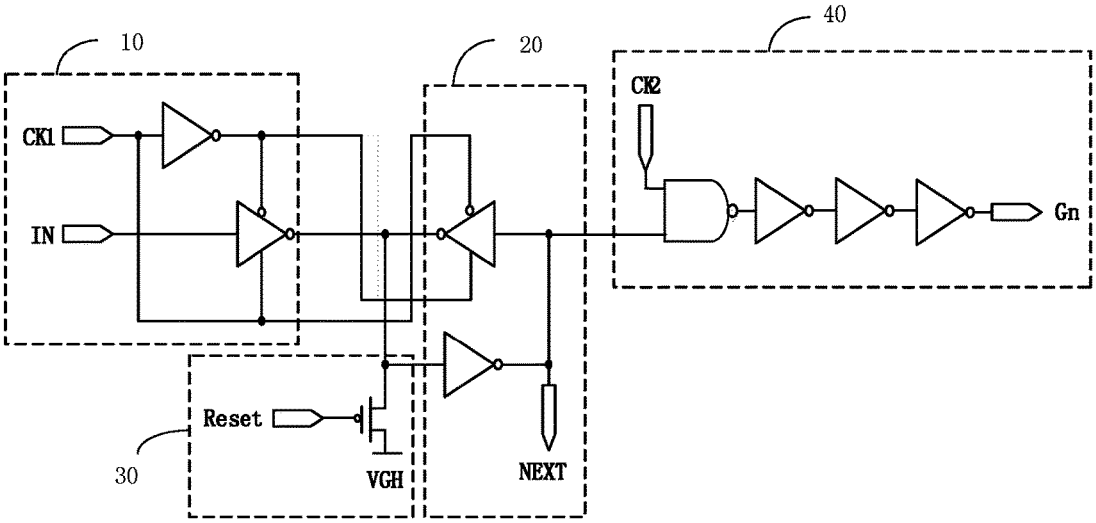
FIG 3(Prior Art)
FIG. 3 is a circuit diagram of the scanning driving unit of one conventional scanning driving circuit.
Figure 4:
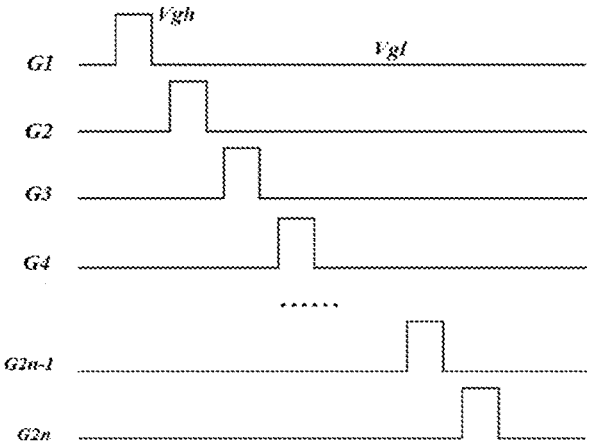
FIG 4(Prior Art)
FIG. 4 is a waveform diagram of the scanning driving signals of the scanning driving unit in FIG. 3.
Figure 5:
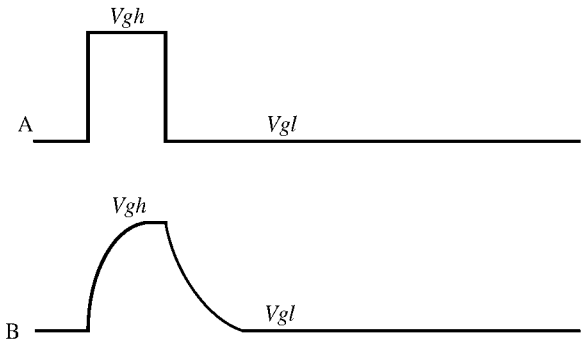
FIG 5(Prior Art)
FIG. 5 is a delayed waveform diagram of the scanning driving signals of the scanning driving unit in FIG. 3.

FIG. 4 is a waveform diagram of the scanning driving signals of the scanning driving unit in FIG. 3, wherein Vgh relates to a high level. When the scanning driving signals are at the high level, the thin film transistor (TFT) connected to the scanning driving signals is turned on, and the corresponding pixel cell is turned on. Vgh relates to a low level, wherein when the scanning driving signals are at the low level, the TFT connected to the scanning driving signals is turned off, and the corresponding pixel cell is turned off. FIG. 5 is a delayed waveform diagram of the scanning driving signals of the scanning driving unit in FIG. 3. It can be seen that the scanning driving signals closer to the point A have very small delay than the scanning driving signals closer to the point B. The voltages at two lateral sides of the panel may be different, which affects the display performance of the panel.

Figure 6:
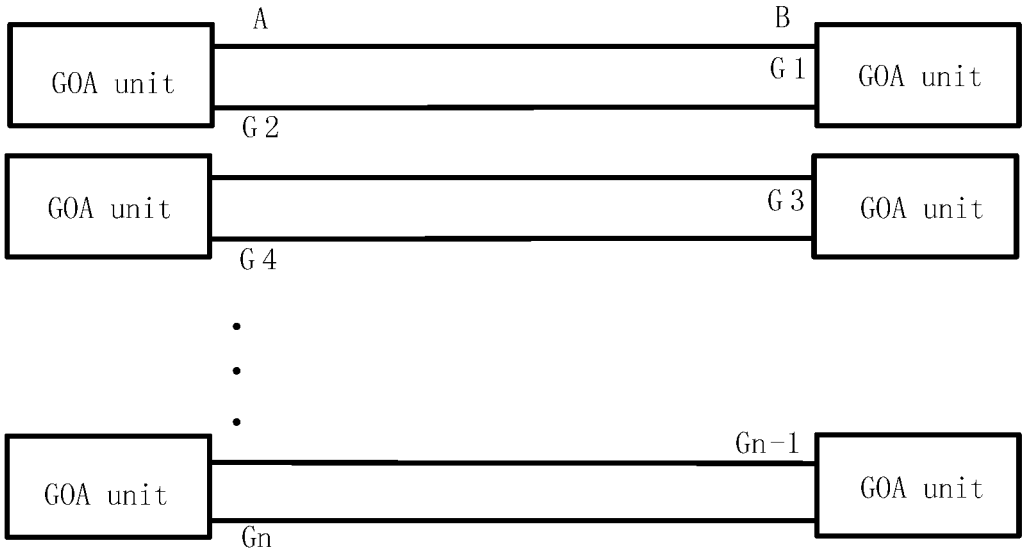
FIG. 6 is a schematic view of the driving method of the scanning driving circuit in accordance with one embodiment.

FIG. 6 is a schematic view of the driving method of the scanning driving circuit in accordance with one embodiment. In view of FIG. 6, the scanning driving circuit includes a plurality of cascaded-connected scanning driving units at two lateral sides of the flat display device. The scanning driving units at two lateral sides and at the same level connect to two scanning lines. For instance, the scanning driving unit at the 1st level of the right side and the scanning driving unit at the 1st level of the left side connect to the scanning lines (G1, G2) at the same time to output the scanning driving signals to the corresponding pixel cells. This may avoid the voltage difference with respect to two lateral sides so as to simplify the circuit design, which contributes to the narrow border design of the flat display device.

Figure 7:
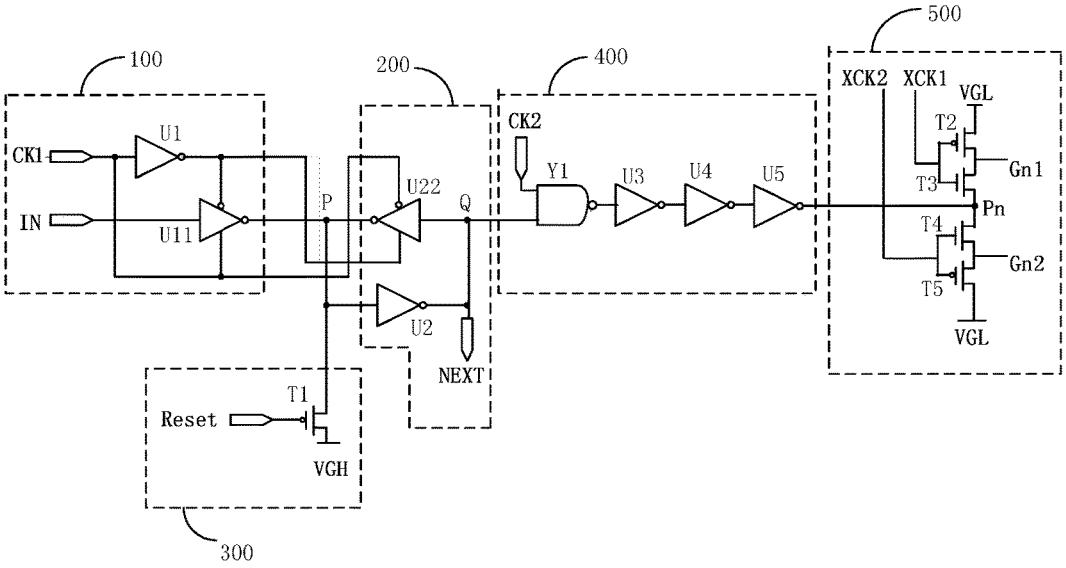
FIG. 7 is a circuit diagram of the scanning driving unit of the scanning driving circuit in accordance with one embodiment.

FIG. 7 is a circuit diagram of the scanning driving unit of the scanning driving circuit in accordance with one embodiment. In the embodiment, only one scanning driving unit is taken as the example to illustrate the present disclosure. As shown in FIG. 7, the scanning driving circuit includes a plurality of cascaded-connected scanning driving units. Each of the scanning driving units includes an input circuit 100 for receiving input signals and first clock signals for charging a pull-up control signal point and a pull-down control signal point, a latch circuit 200 connecting to the input circuit 100 for latching signals received from the input circuit 100, a reset circuit 300 connecting to the input circuit 100 and the latch circuit 200 for resetting a level of the pull-up control signal point, an output circuit 400 connecting to the latch circuit 200 for processing second clock signals and latch data received from the latch circuit 200 to generate scanning driving signals, a clock control circuit 500 connecting to the output circuit 400 for selectively outputting the scanning driving signals generated by the output circuit 400 to the first scanning line or the second scanning line via the third clock signals or the fourth clock signals so as to drive the corresponding pixel cell.

The input circuit 100 includes a first inverter (U1) and a first clock control inverter (U11). An input end of the first inverter (U1) connects to a second end of the first clock control inverter (U11) and the latch circuit 200 to receive the first clock signals, an output end of the first inverter (U1) connects to the first end of the first clock control inverter (U11) connects to the first end of the u11 and the latch circuit 200, the input end of the first clock control inverter (U11) receives the input signals, and an output end of the first clock control inverter (U11) connects to the reset circuit 300 and the latch circuit 200.

The latch circuit 200 includes a second inverter (U2) and a second clock control inverter (U22). An input end of the second inverter (U2) connects to the output end of the first clock control inverter (U11), an output end of the second clock control inverter (U22), and the reset circuit 300. An output end of the second inverter (U2) connects to the input end of the second clock control inverter (U22) and the output circuit 400 to receive the low-level transmission signals, a first end of the second clock control inverter (U22) connects to the second end of the first clock control inverter (U11) and receive the first clock signals, and a second end of the second clock control inverter (U22) connects to the first end of the first clock control inverter (U11) and the output end of the first inverter (U1).

The reset circuit 300 includes a first controllable transistor (T1). A control end of the first controllable transistor (T1) receives the reset signals, a first end of the first controllable transistor (T1) connects to the output end of the first clock control inverter (U11), the output end of the second clock control inverter (U22), and the input end of the second inverter (U2). A second end of the first controllable transistor (T1) receives the turn-on voltage end signals (VGH).

In the embodiment, the first controllable transistor (T1) may be a P-type thin film transistor (TFT). The control end, the first end, the second end of the first controllable transistor (T1) respectively correspond to the gate, the drain, and the source of the P-type TFT. In other embodiments, the first controllable transistor (T1) may be the transistor of other types as long as the technical effects can be realized.

The output circuit 400 includes an NAND gate (Y1) and third to fifth inverters (U3-U5). A first input end of the NAND gate (Y1) receives the second clock signals, a second input end of the NAND gate (Y1) connects to the input end of the second clock control inverter (U22) and the output end of the second inverter (U2), an output end of the NAND gate (Y1) connects to an input end of the third inverter (U3), an output end of the third inverter (U3) connects to an input end of the fourth inverter (U4), an output end of the fourth inverter (U4) connects to an input end of the fifth inverter (U5), and an output end of the fifth inverter (U5) connects to the clock control circuit 500.

The clock control circuit 500 includes second to fifth controllable transistor (T2-T5). A control end of the second controllable transistor (T2) connects to a control end of the third controllable transistor (T3) to receive third clock signals, a first end of the second controllable transistor (T2) receives the turn-off voltage end signals (VGL), a second end of the second controllable transistor (T2), a second end of the second controllable transistor (T2) connects to a first end of the third controllable transistor (T3) and the first scanning line, a second end of the third controllable transistor (T3) connects to a first end of the fourth controllable transistor (T4) and an output end of the fifth inverter (U5), a control end of the fourth controllable transistor (T4) connects to the control end of the fifth controllable transistor (T5) to receive fourth clock signals, a second end of the fourth controllable transistor (T4) connects to a first end of the fifth controllable transistor (T5) and the second scanning line, and a second end of the fifth controllable transistor (T5) receives the turn-off voltage end signals (VGL).

In the embodiment, the second to the fifth controllable transistors (T2-T5) are P-type TFTs. The control ends, the first ends, the second ends of the second to the fifth controllable transistors (T2-T5) respectively correspond to the gate, drain, and the source of the P-type TFTs. The third to the fourth controllable transistors (T3, T4) are N-type TFTs. The control ends, the first ends, and the second ends of the third controllable transistor (T3) and the fourth controllable transistor (T4) respectively correspond to the gate, the drain, and the source of the N-type TFTs. In other embodiments, the second to the fifth controllable transistors may be the transistors of other types.

Figure 8:
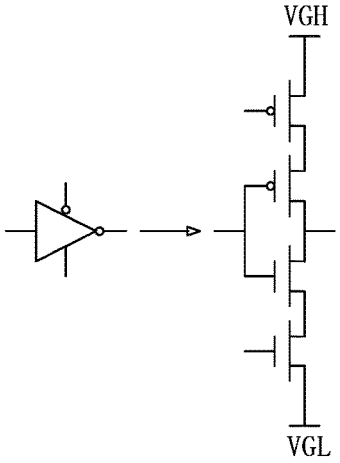
FIG. 8 is a schematic view of the clock control inverter in FIG. 7.

FIG. 8 is a schematic view of the clock control inverter in FIG. 7. The clock control inverter may be a general one, and thus the descriptions are omitted hereinafter.

In the embodiment, the first clock signals are indicated as CK1, the second clock signals are indicated as CK2, the third clock signals are indicated as XCK1, and the fourth clock signals are indicated as XCK2, the input signals are indicated as IN, the low-level transmission signals are indicated as NEXT, the pull-down control signal point is indicated as P, a first scanning line is indicated as Gn1, and the second scanning line is indicated as Gn2.

Figure 9:
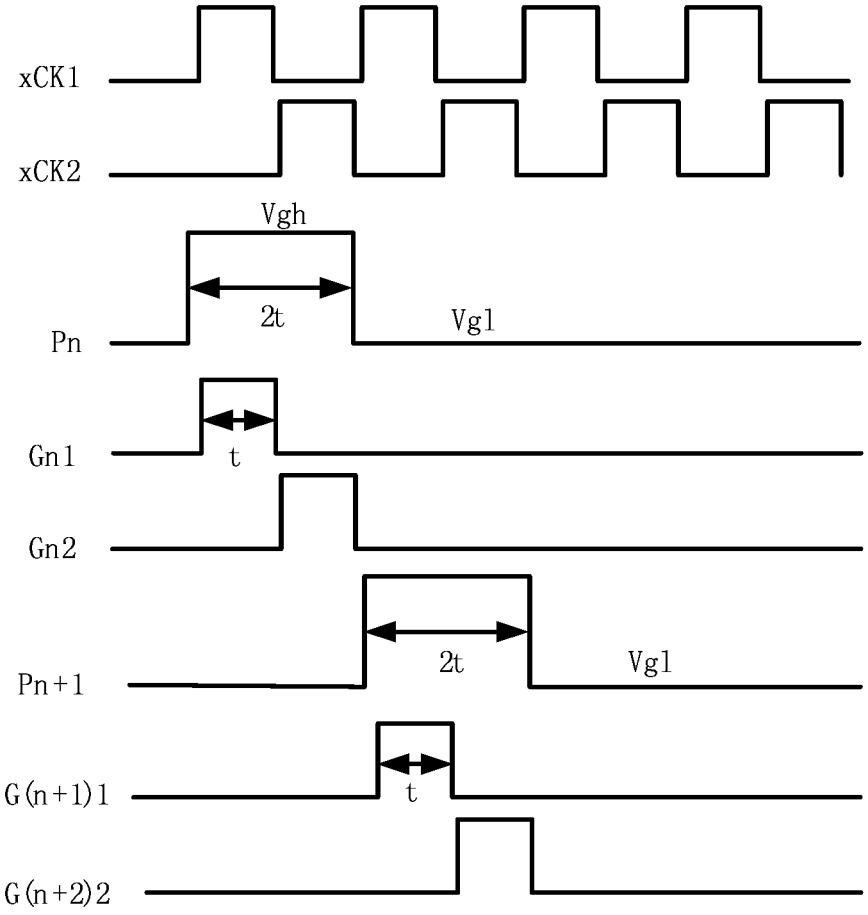
FIG. 9 is a waveform diagram of the scanning driving signals of the scanning driving unit in FIG. 7.

FIG. 9 is a waveform diagram of the scanning driving signals of the scanning driving unit in FIG. 7.

At this moment, when the third clock signals (XCK1) are at the high level and the fourth clock signals (XCK2) are at the low level, the third controllable transistor (T3) and the fifth controllable transistor (T5) are turned on and the second controllable transistor (T2) and the fourth controllable transistor (T4) are turned off. The turn-off voltage end signals (VGL) outputs the low level signals to the second scanning line (Gn2) to turn off the corresponding pixel cell. At the same time, the point (Pn) outputs the high level signals to the first scanning line (Gn1) to turn on the corresponding pixel cell, such that the scanning driving signals are selectively outputted to the first scanning line (Gn1) or the second scanning line (Gn2) by the third clock signals (XCK1) and the fourth clock signals (XCK2) and the corresponding pixel cell is controlled.

When one of the third clock signals (CK1) and the input signals (IN) are at the low level and the other one are at the high level, or when the both of the third clock signals (CK1) and the input signals (IN) are at the low level, the second input end of the first inverter (U1) receives the low level signals. At this moment, the NAND gate (Y1) outputs the high level regardless of whether the second clock signals (CK2) are at the high level or at the low level. The high level pass through the third to the fifth inverters (U3-U5) and transits to the low level, and the low level is provided to the point (Pn). At this moment, the first scanning line (Gn1) and the second scanning line (Gn2) receives the low level signals for turning off the corresponding pixel cell, regardless of whether the third clock signals (XCK1) and the fourth clock signals (XCK2) are at the high level or at the low level. The other scanning driving units operate in accordance with the principle described above.

Figure 10:
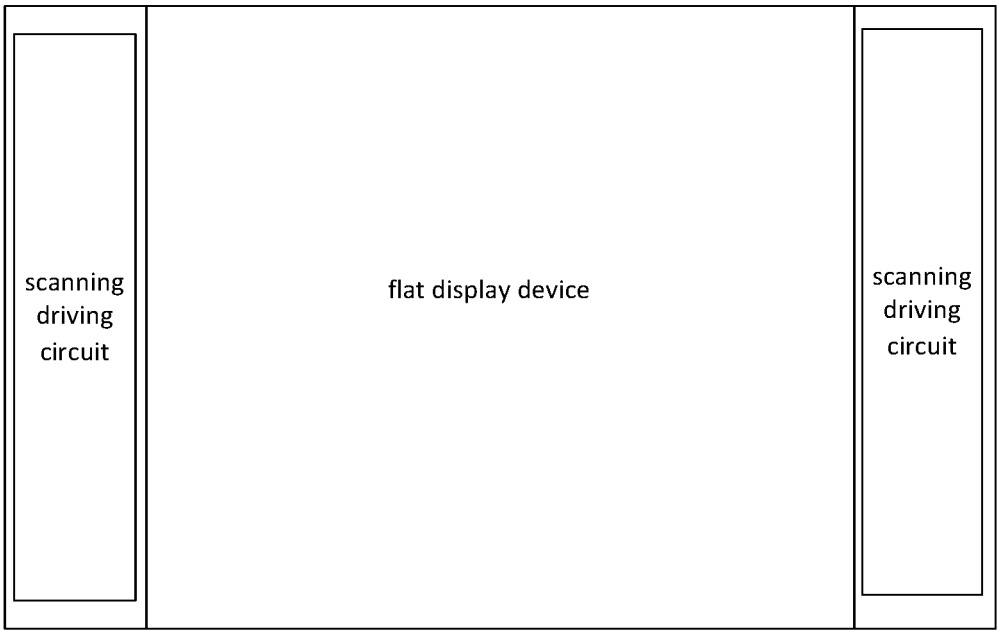
FIG. 10 is a schematic view of the flat display device in accordance with one embodiment.

FIG. 10 is a schematic view of the flat display device in accordance with one embodiment. The flat display device includes the above scanning driving circuit. The left and the right side of the flat display device are respectively configured with cascaded-connected scanning driving units, wherein the levels of the scanning driving unit for the left side and the right side are the same. The scanning driving units at the right side and the left side of the same level connect to the two same scanning line such that the scanning driving signals are selectively outputted to the first scanning line or the second scanning line to drive the corresponding pixel cell via the third clock signals (XCK1) and the fourth clock signals (XCK2). The scanning driving units arranged at the left side are the same with the scanning driving units arranged at the right side. In addition, each of the scanning driving units at the left side and each of the scanning driving units at the right side are controlled by the third clock signals (CK1) and the second clock signals (CK2). Compared to the present disclosure, the clock signals (CK1, CK2) have to configured within the scanning driving units at the left side and the clock signals (CK3, CK4) have to configured within the scanning driving unit at the right side with respect to the conventional solution. The flat display device may be LCD or OLED.

In view of the above, the left and the right side of the flat display device are respectively configured with cascaded-connected scanning driving units, wherein the levels of the scanning driving units for the left side and the right side are the same. The scanning driving units at the right side and the left side of the same level connect to the two same scanning line such that the scanning driving signals are selectively outputted to two scanning lines to drive the corresponding pixel cell via the clock control circuit. The input circuit charges the pull-up control signal point and the pull-down control signal point, and the signals are latched by the latch circuit. The output circuit generates the scanning driving signals and the scanning driving signals are selectively outputted to the first or second scanning lines to drive the corresponding pixel cell by the clock control circuit. With such configuration, the voltages at two sides of the flat display device may be the same. Not only the circuit design may be simplified, but also the space occupied by the circuit is reduced. Thus, the narrow border design of the flat may be realized.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A scanning driving circuit, comprising: a plurality of cascaded-connected scanning driving units respectively arranged at two lateral sides of a flat display device, with respect to the same level, the scanning driving unit at a right side and the scanning driving unit at a left side connect to two the same scanning lines, each of the scanning driving units comprises:

an input circuit is configured to receive input signals and first clock signals to charge a pull-up control signal point and a pull-down control signal point;

a latch circuit connected to the input circuit, and the latch circuit is configured to latch signals received from the input circuit;

a reset circuit connected to the input circuit and the latch circuit, and the reset circuit is configured to reset a level of the pull-up control signal point;

an output circuit connected to the latch circuit, and the output circuit is configured to process second clock signals and data receives from the latch circuit to generate scanning driving signals; and a clock control circuit connected to the output circuit, and the clock control circuit selectively outputs the scanning driving signals outputted from the output circuit to the first scanning line or the second scanning line via third clock signals or fourth clock signals to drive a corresponding pixel cell, wherein the output circuit comprises a first inverter and a first clock control inverter, an input end of the first inverter connects to a second end of the first clock control inverter and the latch circuit to receive the first clock signals, an output end of the first inverter connects to a first end of the first clock control inverter and the latch circuit, an input end of the first clock control inverter receives input signals, and an output end of the first clock control inverter connects to the reset circuit and the latch circuit, wherein the latch circuit comprises a second inverter and a second clock control inverter, an input end of the second inverter connects to the output end of the first clock control inverter, an output end of the second clock control inverter, and the reset circuit, an output end of the second inverter connects to the input end of the second clock control inverter and the output circuit to receive low-level transmission signals, a first end of the second clock control inverter connects to the second end of the first clock control inverter and receives the first clock signals, and a second end of the second clock control inverter connects to the first end of the first clock control inverter and the output end of the first inverter, wherein the reset circuit comprises a first controllable transistor, a control end of the first controllable transistor receives the reset signals, a first end of the first controllable transistor connects to the output end of the first clock control inverter, the output end of the second clock control inverter, and the input end of the second inverter, and a second end of the first controllable transistor receives turn-on voltage end signals, wherein the output circuit comprises an NAND gate and third to fifth inverters, a first input end of the NAND gate receives the second clock signals, a second input end of the NAND gate connects to the input end of the second clock control inverter and the output end of the second inverter, an output end of the NAND gate connects to an input end of the third inverter, an output end of the third inverter connects to an input end of the fourth inverter, an output end of the fourth inverter connects to an input end of the fifth inverter, and an output end of the fifth inverter connects to the clock control circuit, and wherein the clock control circuit comprises second to fifth controllable transistors, a control end of the second controllable transistor connects to a control end of the third controllable transistor to receive third clock signals, a first end of the second controllable transistor receives the turn-off voltage end signals, a second end of the second controllable transistor, a second end of the second controllable transistor connects to a first end of the third controllable transistor and the first scanning line, a second end of the third controllable transistor connects to a first end of the fourth controllable transistor and an output end of the fifth inverter, a control end of the fourth controllable transistor connects to the control end of the fifth controllable transistor to receive fourth clock signals, a second end of the fourth controllable transistor connects to a first end of the fifth controllable transistor and the second scanning line, and a second end of the fifth controllable transistor receives the turn-off voltage end signals.

2. The scanning driving circuit as claimed in claim 1, wherein the first controllable transistor is a P-type thin film transistor (TFT), the control end, the first end, and the second end of the first controllable transistor respectively correspond to a gate, a drain, and a source of the P-type TFT.

3. The scanning driving circuit as claimed in claim 1, wherein the second to the fifth controllable transistors are P-type TFTs, the control ends, the first ends, the second ends of the second to the fifth controllable transistors respectively correspond to the gate, drain, and the source of the P-type TFTs, the third to the fourth controllable transistors are N-type TFTs, and the control ends, the first ends, and the second ends of the third controllable transistor and the fourth controllable transistor respectively correspond to the gate, the drain, and the source of the N-type TFTs.

4. A flat display device, comprising:

a plurality of cascaded-connected scanning driving units respectively arranged at two lateral sides of a flat display device, with respect to the same level, the scanning driving unit at a right side and the scanning driving unit at a left side connect to two the same scanning lines, each of the scanning driving units comprises:

an input circuit is configured to receive input signals and first clock signals to charge a pull-up control signal point and a pull-down control signal point;

a latch circuit connected to the input circuit, and the latch circuit is configured to latch signals received from the input circuit;

a reset circuit connected to the input circuit and the latch circuit, and the reset circuit is configured to reset a level of the pull-up control signal point;

an output circuit connected to the latch circuit, and the output circuit is configured to process second clock signals and data receives from the latch circuit to generate scanning driving signals; and a clock control circuit connected to the output circuit, and the clock control circuit selectively outputs the scanning driving signals outputted from the output circuit to the first scanning line or the second scanning line via third clock signals or fourth clock signals to drive a corresponding pixel cell, wherein the output circuit comprises a first inverter and a first clock control inverter, an input end of the first inverter connects to a second end of the first clock control inverter and the latch circuit to receive the first clock signals, an output end of the first inverter connects to a first end of the first clock control inverter and the latch circuit, an input end of the first clock control inverter receives input signals, and an output end of the first clock control inverter connects to the reset circuit and the latch circuit wherein the latch circuit comprises a second inverter and a second clock control inverter, an input end of the second inverter connects to the output end of the first clock control inverter, an output end of the second clock control inverter, and the reset circuit, an output end of the second inverter connects to the input end of the second clock control inverter and the output circuit to receive low-level transmission signals, a first end of the second clock control inverter connects to the second end of the first clock control inverter and receives the first clock signals, and a second end of the second clock control inverter connects to the first end of the first clock control inverter and the output end of the first inverter, wherein the reset circuit comprises a first controllable transistor, a control end of the first controllable transistor receives the reset signals, a first end of the first controllable transistor connects to the output end of the first clock control inverter, the output end of the second clock control inverter, and the input end of the second inverter, and a second end of the first controllable transistor receives turn-on voltage end signals, wherein the output circuit comprises an NAND gate and third to fifth inverters, a first input end of the NAND gate receives the second clock signals, a second input end of the NAND gate connects to the input end of the second clock control inverter and the output end of the second inverter, an output end of the NAND gate connects to an input end of the third inverter, an output end of the third inverter connects to an input end of the fourth inverter, an output end of the fourth inverter connects to an input end of the fifth inverter, and an output end of the fifth inverter connects to the clock control circuit, and wherein the clock control circuit comprises second to fifth controllable transistors, a control end of the second controllable transistor connects to a control end of the third controllable transistor to receive third clock signals, a first end of the second controllable transistor receives the turn-off voltage end signals, a second end of the second controllable transistor, a second end of the second controllable transistor connects to a first end of the third controllable transistor and the first scanning line, a second end of the third controllable transistor connects to a first end of the fourth controllable transistor and an output end of the fifth inverter, a control end of the fourth controllable transistor connects to the control end of the fifth controllable transistor to receive fourth clock signals, a second end of the fourth controllable transistor connects to a first end of the fifth controllable transistor and the second scanning line, and a second end of the fifth controllable transistor receives the turn-off voltage end signals.

5. The flat display device as claimed in claim 4, wherein the first controllable transistor is a P-type thin film transistor (TFT), the control end, the first end, and the second end of the first controllable transistor respectively correspond to a gate, a drain, and a source of the P-type TFT.

6. The flat display device as claimed in claim 4, wherein the second to the fifth controllable transistors are P-type TFTs, the control ends, the first ends, the second ends of the second to the fifth controllable transistors respectively correspond to the gate, drain, and the source of the P-type TFTs, the third to the fourth controllable transistors are N-type TFTs, and the control ends, the first ends, and the second ends of the third controllable transistor and the fourth controllable transistor respectively correspond to the gate, the drain, and the source of the N-type TFTs.

7. The flat display device as claimed in claim 4, wherein the flat display device is a liquid crystal device (LCD) or an organic light-emitting diode (OLED).

* * * * *